US006710528B2

(12) United States Patent
Takahashi et al.

(10) Patent No.: US 6,710,528 B2
(45) Date of Patent: Mar. 23, 2004

(54) SHADOW MASK AND COLOR CATHODE RAY TUBE

(75) Inventors: Tohru Takahashi, Osato-gun (JP); Masatsugu Inoue, Kumagaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/015,625

(22) Filed: Dec. 17, 2001

(65) Prior Publication Data

US 2002/0084737 A1 Jul. 4, 2002

(30) Foreign Application Priority Data

Dec. 28, 2000 (JP) ..... 2000-402314

(51) Int. Cl.[7] ..... H01J 29/80
(52) U.S. Cl. ..... 313/402; 313/403
(58) Field of Search ..... 313/402, 403, 313/408

(56) References Cited

U.S. PATENT DOCUMENTS 3,707,640 A * 12/1972 Lerner ..... 313/402
5,730,887 A * 3/1998 Simpson et al. ..... 216/12
6,313,574 B1 * 11/2001 Banno et al. ..... 313/402

FOREIGN PATENT DOCUMENTS

| | | | |
|---|---|---|---|
| JP | 50-142159 | 11/1975 | |
| JP | 55-064347 | 5/1980 | |
| JP | JP 01187740 A | 7/1999 | ..... H01J/29/07 |

* cited by examiner

*Primary Examiner*—Vip Patel
*Assistant Examiner*—German Colón
(74) *Attorney, Agent, or Firm*—Oblon, Spivak, McClelland, Maier & Neustadt, P.C.

(57) ABSTRACT

A shadow body includes an effective area having minor and major axes that extend perpendicularly to each other. Each of electron beam passage apertures formed in the effective area is a communication hole that connects a larger hole opening in one surface of the effective area and a smaller hole opening in the other surface of the effective area. A joint portion between the larger and smaller holes of each electron beam passage apertures in the central portion of the effective area is situated in the thickness-direction central portion of the mask body. A joint portion between the larger and smaller holes of each electron beam passage aperture in the peripheral portion of the effective area is situated closer to the one surface side of the effective area than the thickness-direction central portion is, the larger hole being offset against the smaller hole in the direction of the major axis.

2 Claims, 3 Drawing Sheets

SHADOW MASK AND COLOR CATHODE RAY TUBE

CROSS-REFERENCE TO RELATED APPLICATIONS

This application is based upon and claims the benefit of priority from the prior Japanese Patent Application No. 2000-402314, filed Dec. 28, 2000, the entire contents of which are incorporated herein by reference.

BACKGROUND OF THE INVENTION

1. Field of the Invention

The present invention relates to a shadow mask and a color cathode ray tube provided with the shadow mask.

2. Description of the Related Art

In general, color cathode ray tubes that are used in color TV sets, color terminal displays, etc., comprise an envelope that includes a substantially rectangular face panel and a funnel bonded integrally to the face panel. A phosphor screen of the black-matrix or -stripe type having three-color phosphor layers that glow blue, green, and red, individually, is formed on the inner surface of the face panel.

In the envelope, a shadow mask for color sorting is opposed to the phosphor screen. The shadow mask is formed having a large number of electron beam passage apertures through which electron beams pass. The shadow mask is fixed to a mask frame, which is attached to the inner surface of the face panel by means of stud pins. A magnetic shielding plate is also attached to the mask frame.

Located in a neck of the funnel, moreover, is an in-line electron gun, which emits electron beams including a center beams and a pair of side beams. In the color cathode ray tube, the electron beams emitted from the electron gun are deflected by a magnetic field, which is generated by a deflection yoke on the outside of the funnel, and scan the phosphor screen in the horizontal and vertical directions through the shadow mask, thereby displaying a color image on the screen.

The shadow mask is made of a substantially rectangular metal sheet having a large number of electron beam passage apertures formed by etching. The electron beam passage apertures can be roughly classified into two types, a circular-dot type and a rectangular-slit type. Shadow masks having electron beam passage apertures of the circular-dot type are mainly used for display tubes that primarily display characters and graphics. On the other hand, shadow masks having electron beam passage apertures of the rectangular-slit type are mainly used for consumer color cathode ray tubes for color TV sets and the like.

Basically, in the shadow mask of either type, each electron beam passage aperture is formed of a communication hole, in which a larger hole in that surface of the shadow mask which faces the phosphor screen connects with a smaller hole in the opposite surface of the mask that faces the electron gun. The aperture of the electron beam passage aperture is practically settled depending on the diameter of a joint portion at which the respective bottoms of the larger and smaller holes are connected to each other.

In the central portion of an effective area of the shadow mask, the joint portion of each electron beam passage aperture is situated eccentrically on the electron gun side of the thickness-direction center of the shadow mask, while the larger and smaller holes of each electron beam passage aperture are concentric with each other.

In those peripheral portions of the effective area of the shadow mask which are deviated from the region near the minor axis of the effective area in the direction of its major axis, the central axis of the larger hole of each electron beam passage aperture is offset against that of the smaller hole in a direction that recedes from the center of the effective area. Accordingly, the joint portion of each electron beam passage aperture in the peripheral portions is situated nearer to the electron gun side in the thickness-direction of the shadow mask than the joint portion of each electron beam passage aperture in the central portion of the effective area. By use of these offset electron beam passage apertures, the electron beams can be prevented from running against the respective inner surfaces of the electron beam passage apertures or aperture edges of the larger holes in the peripheral portion of the shadow mask where the electron beams are deflected at wider angles. In consequence, the electron beams that are passed through the electron beam passage apertures and landed on the phosphor screen can be prevented from being distorted.

With the development of large-screen versions of color TV sets and the like, on the other hand, flat square tubes have become prevalent consumer color cathode ray tubes. These tubes have a flat screen that reflects less external light and suffers less image distortion. Further, perfectly flat tubes, which have a face panel with a substantially perfectly flat outer surface, have become popular in the market, and are expected to be prevailing color cathode ray tubes for the future.

In one such flat tube, the effective area of the shadow mask is flattened corresponding to the shape of the inner surface of the face panel, so that the shadow mask has a smaller curvature (or a greater radius of curvature) than that of the shadow mask of a conventional color cathode ray tube of which the panel has a curved outer surface.

If the curvature of the shadow mask is reduced in this manner, its curved surface retention (hereinafter referred to as mask strength) lowers, so that it is hard for the mask to maintain its curved surface, resisting its own weight or external force. If the mask strength is low, the curved surface of the shadow mask is inevitably deformed by a minor external force that acts on it during manufacture or transportation. The deformation of the shadow mask changes the distance between the electron beam passage apertures and the inner surface of the panel. In consequence, the electron beams fail to land on the specific phosphor layers, thereby causing a color drift.

If the mask strength is low, moreover, the curved surface of the shadow mask easily resonates with vibration such as a sound from a speaker when the mask is incorporated in a TV set or the like. If the shadow mask resonates, unnecessary light and shade that involve fluctuation in brightness appear on the screen, so that the image quality level lowers.

The mask strength decreases most severely in the central portion of the effective area, and increases as the periphery of the effective area is approached. Thus, if a uniform load is applied to the whole surface of the shadow mask, the mask undergoes a great displacement in the central portion of the effective area and a smaller displacement in the peripheral portion of the effective area. The peripheral portion of the effective area of the shadow mask is provided with a skirt, to which the shadow mask is fixed by welding, so that the mask strength in the peripheral portion of the effective area is increased.

In order to improve the strength of the shadow mask as a whole, therefore, the strength of the central portion of its effective area must be increased. The easiest method to increase the mask strength is to thicken the shadow mask. If the thickness of the shadow mask is increased, however, etching speed control during the manufacture of the mask is so hard that the respective apertures of the electron beam passage apertures are subject to substantial irregularity. In consequence, the yield of production of shadow masks and color cathode ray tubes lowers, and the resulting pictures are subject to unevenness in brightness or color, so that the image quality level is lowered inevitably.

BRIEF SUMMARY OF THE INVENTION

The present invention has been contrived in consideration of these circumstances, and its object is to provide a shadow mask improved in strength without increasing its thickness and a color cathode ray tube capable of ensuring an improved image quality level.

In order to achieve the above object, a shadow mask according to an aspect of the invention comprises a mask body including a substantially rectangular effective area having a minor axis and a major axis extending at right angles to each other and a large number of electron beam passage apertures formed in the effective area. Each of the electron beam passage apertures is formed of a communication hole connecting a larger hole opening in one surface of the effective area and a smaller hole opening in the other surface of the effective area. In a cross section of the mask body in the major axis direction, a joint portion between the larger and smaller holes of each of at least the electron beam passage apertures in the central portion of the effective area is situated in a central portion in the thickness-direction of the mask body. In a cross section of the mask body in the major axis direction, a joint portion between the larger and smaller holes of each of the electron beam passage apertures located on the major axis and in the peripheral portion of the effective area is situated closer to one of the surface sides of the effective area than the joint portion of each of the electron beam passages apertures in the central portion of the effective area, the larger hole being offset against the smaller hole in the direction of the major axis.

A color cathode ray tube according to another aspect of the invention comprises an envelope including a substantially rectangular face panel having a phosphor screen on the inner surface thereof, a shadow mask opposed to the phosphor screen, and an electron gun for emitting electron beams toward the phosphor screen through the shadow mask.

The shadow mask comprises a mask body including a substantially rectangular effective area having a minor axis and a major axis extending at right angles to each other and a large number of electron beam passage apertures formed in the effective area. Each of the electron beam passage apertures is formed of a communication hole connecting a larger hole opening in one surface of the effective area and a smaller hole opening in the other surface of the effective area. In a cross section of the mask body in the major axis direction, a joint portion between the larger and smaller holes of each of at least the electron beam passage apertures in the central portion of the effective area is situated in a central portion in the thickness-direction of the mask body. In a cross section of the mask body in the major axis direction, a joint portion between the larger and smaller holes of each of the electron beam passage apertures located on the major axis and in the peripheral portion of the effective area is situated closer to one of the surface sides of the effective area than the joint portion of each of the electron beam passages apertures in the central portion of the effective area, the larger hole being offset against the smaller hole in the direction of the major axis.

According to the shadow mask and the color cathode ray tube constructed in this manner, the extent of etching of the shadow mask for the formation of the electron beam passage apertures can be lowered despite the equality of the shadow mask to a conventional one in thickness. Thus, the volume of the etched shadow mask can be increased to improve the mask strength.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A color cathode ray tube according to an embodiment of the present invention will now be described in detail with reference to the accompanying drawings.

Figure 1:
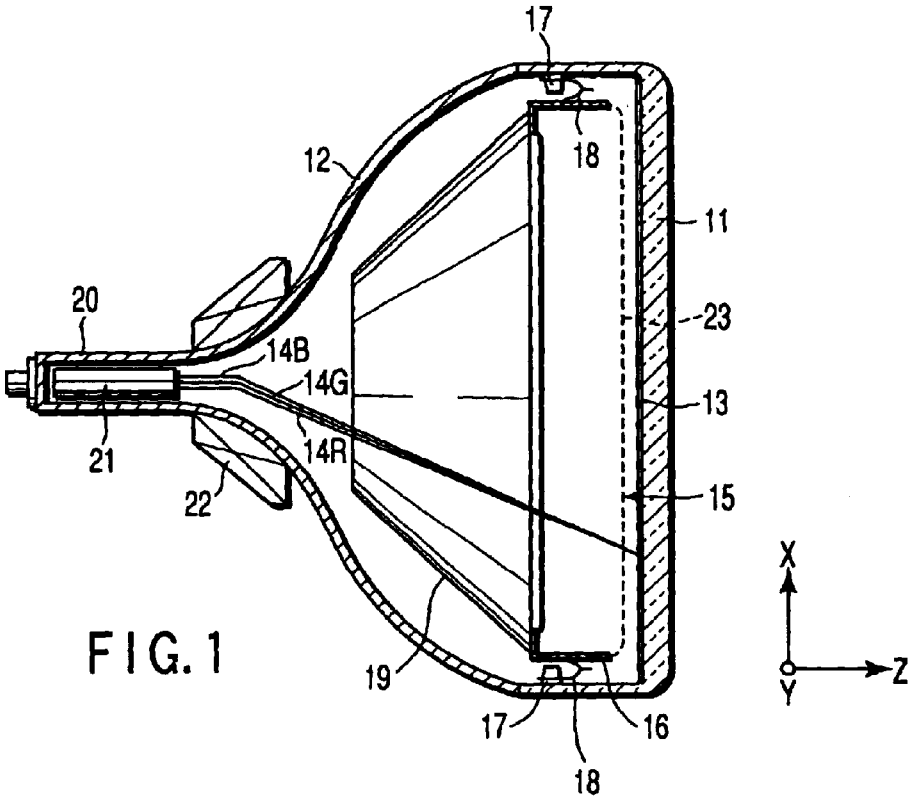
FIG. 1 is a sectional view showing a color cathode ray tube according to an embodiment of the invention.

As shown in FIG. 1, the color cathode ray tube comprises an envelope that includes a substantially rectangular face panel 11 and a funnel 12 bonded integrally to the face panel 11. A phosphor screen 13 having three-color phosphor layers that glow blue, green, and red, individually, is formed on the inner surface of the face panel 11.

The phosphor screen 13 is of the black-matrix or -stripe type in which dot- or stripe-shaped three-color phosphor layers are embedded individually in gap portions between light absorbing layers by photographic printing.

In the face panel 11, a shadow mask 15 for color sorting is opposed to the phosphor screen 13. The shadow mask 15 has a mask body 23, which is formed having a large number of electron beam passage apertures (mentioned later), and a mask frame 16 that supports the peripheral edge portion of the mask body. The shadow mask 15 is attached to the inside of the face panel 11 in a manner such that a plurality of elastic supports 18 on the mask frame 16 are engaged individually with stud pins 17 that protrude from the inner surface of the panel 11. Further, a magnetic shielding plate 19 is attached to the mask frame 16. The mask body 23 is formed of Invar (Fe—Ni alloy), a low-expansion material, with a thickness of 0.22 mm, for example.

Located in a neck 20 of the funnel 12 is an in-line electron gun 21, which emits electron beams 14B, 14G and 14R that are arranged in a line in the horizontal direction. In the color cathode ray tube, the three electron beams 14B, 14G and 14R emitted from the electron gun 21 are deflected by means of a magnetic field that is generated by a deflection yoke 22 on the outside of the funnel 12. As the phosphor screen 13 is scanned in the horizontal and vertical directions with the aid of the shadow mask 15, a color image is displayed on the screen 13.

A self-convergence deflection yoke is used as the deflection yoke 22. This deflection yoke forms a non-uniform magnetic field, which includes a horizontally deflecting magnetic field of the pincushion type generated by means of a horizontally deflecting coil and a vertically deflecting magnetic field of the barrel type generated by means of a vertically deflecting coil, and causes the three electron beams 14B, 14G and 14R to self-converge.

Figure 2:
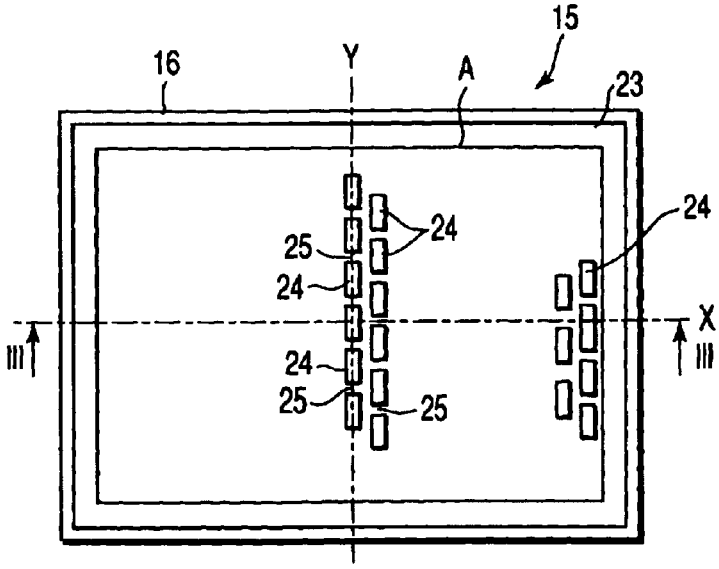
FIG. 2 is a plan view showing a shadow mask of the color cathode ray tube.
Figure 3:
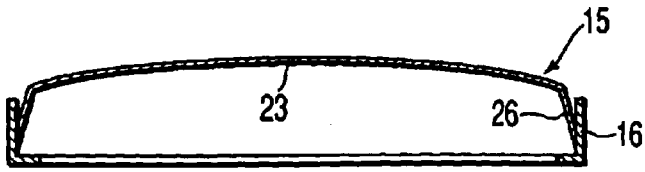
FIG. 3 is a sectional view of the shadow mask taken along line III—III of FIG. 2.

The following is a detailed description of the shadow mask 15. As shown in FIGS. 1 to 3, the shadow mask 15 includes the mask body 23 having a substantially rectangular effective area A that is opposed to the phosphor screen 13. The effective area A is formed having a plurality of electron beam passage apertures 24 for sorting the electron beams 14B, 14G and 14R that are emitted from the electron gun 21 and land on the phosphor screen 13.

The effective area A of the mask body 23 has a major axis X that extends perpendicularly to a tube axis Z and a minor axis Y that extends at right angles to the tube axis and the major axis. Each electron beam passage aperture 24 is substantially in the form of a rectangle that has its width in the direction of the major axis X. The electron beam passage apertures 24 form a plurality of aperture rows each including a plurality of electron beam passage apertures that are arranged straight at pitches of, for example, 0.6 mm in the direction of the minor axis Y of the effective area A with bridges 25 between them. These aperture rows are arranged at given pitches in the direction of the major axis X. For example, the arrangement pitch of the electron beam passage aperture rows in the direction of the major axis X are 0.75 mm near the minor axis Y and 0.82 mm in the major-axis-direction periphery. Thus, the aperture rows are arranged at variable pitches that increase with distance from the minor axis Y. Further, the mask body 23 has a skirt portion 26 that is formed by bending its peripheral edge portion and welded to the mask frame 16.

Figure 4A:
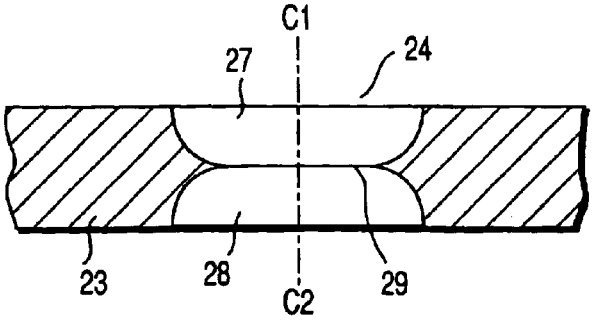
FIG. 4A is an enlarged sectional view showing an electron beam passage aperture in the central portion of the shadow mask.
Figure 4B:
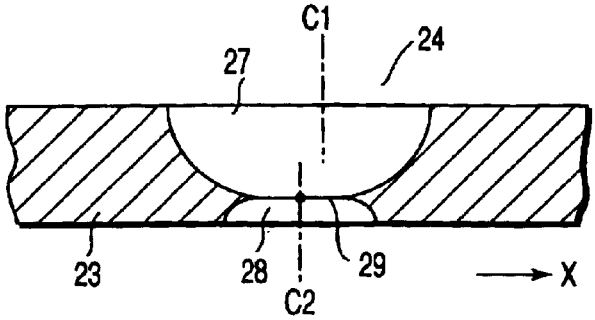
FIG. 4B is an enlarged sectional view showing an electron beam passage aperture in the peripheral portion of the shadow mask.

As shown in FIGS. 4A and 4B, each electron beam passage aperture 24 is a communication hole formed of a rectangular larger hole 27 that opens in the screen-side surface of the mask body 23 and a substantially rectangular smaller hole 28 that opens in that surface of the mask body which faces the electron gun 21. The respective bottoms of the larger and smaller holes 27 and 28 are connected to each other. The larger and smaller holes 27 and 28 are formed by etching. The shape and aperture diameter of each electron beam passage aperture 24 is settled depending on those of a joint portion 29 between the larger and smaller holes 27 and 28.

For example, each larger hole 27 is in the form of a substantially rectangular slit. The crosswise aperture dimension of each larger hole 27 on the minor axis Y is adjusted to 0.46 mm, and that of each larger hole 27 in the major-axis-direction periphery to 0.50 mm. Each smaller hole 28 is also in the form of a substantially rectangular slit. The crosswise aperture dimension of each larger smaller hole 28 on the minor axis Y is adjusted to 0.18 mm, and that of each smaller hole 28 in the major-axis-direction periphery to 0.20 mm.

In the central portion of the effective area A, especially on the minor axis Y and beside it, each electron beam passage aperture 24 is in the form of a coaxial hole in which the respective central axes C1 and C2 of the larger and smaller holes 27 and 28 are coincident, as shown in FIG. 4A. The joint portion 29 of each electron beam passage aperture 24 is situated in the thickness-direction central portion of the mask body 23, and projects toward the central axes C1 and C2 of the larger and smaller holes 27 and 28.

In the region near the short side of the effective area A and at a distance from the minor axis Y in the direction of the major axis X, that is, in the peripheral portion of the effective area A, each electron beam passage aperture 24 is in the form of an eccentric hole in which the central axis C1 of the larger hole 27 is deviated from the central axis C2 of the smaller hole 28 in a direction such that it recedes from the minor axis Y of the effective area A, as shown in FIG. 4B. The joint portion 29 of each electron beam passage aperture 24 is situated close to that portion of the surface which is situated nearer to the electron gun than the center is in the thickness direction of the mask body 23.

If the color cathode ray tube is designed such that electron beams 14 are incident at a deflection angle of 46° upon the electron beam passage apertures 24 in the periphery of the shadow mask in the major-axis-direction, for example, the larger hole 27 that constitutes each electron beam passage aperture 24 in the major-axis-direction periphery is located with an eccentricity of 0.06 mm to the smaller hole 28.

According to the color cathode ray tube constructed in this manner, the mechanical strength of the shadow mask 15 can be increased to improve the image quality level, as described below.

In order to enhance the strength of the shadow mask 15 without increasing the thickness of the mask, it is necessary that useless etching of the mask body be minimized to increase the volume of the etched mask body. In the case of a flat tube, in particular, the strength of the entire shadow mask 15 can be enhanced if the mask body volume in the central portion of the effective area that is relatively low in strength is increased with priority.

Since the effective aperture diameter of each electron beam passage aperture 24 is normally settled depending on its smallest portion, it obeys the joint portion 29 between the larger and smaller holes 27 and 28. If the respective effective aperture diameters of the electron beam passage apertures 24 are supposed to be the same, the volume of the mask body 23 can be maximized by locating the joint portion 29 of each electron beam passage aperture in the central portion with respect to the thickness direction of the mask body 23.

In a case wherein the respective inner surfaces of the electron beam passage apertures 24 that are formed by etching have a common angle of inclination, in other words, if the joint portion 29 between the larger and smaller holes 27 and 28 is located at the center in the thickness-direction of the shadow mask 15, the electron beam passage apertures can be formed with the minimum extent of etching so that the mask body 23 has the largest volume.

If the volume of the mask body 23 is large, then the shadow mask material can be assumed to be equivalently thick. Thus, if the shadow mask used is as thick as a conventional one, its use is equivalent to use of a thicker shadow mask, so that the mask strength can be improved.

Figure 5A:
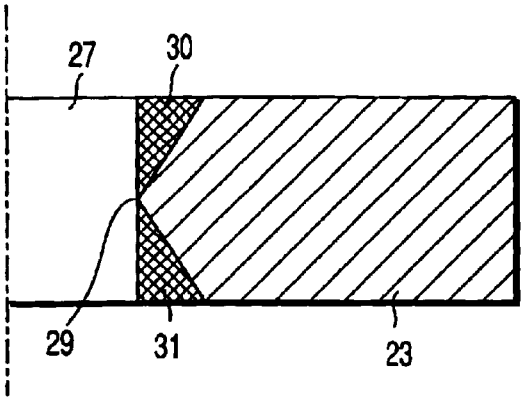
FIG. 5A is a view schematically showing the way an electron beam in the central portion of the shadow mask is formed by etching.
Figure 5B:
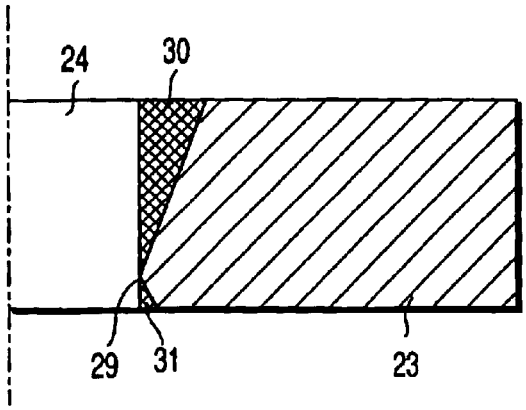
FIG. 5B is a view schematically showing the way an electron beam in the peripheral portion of the shadow mask is formed by etching.

In FIGS. 5A and 5B, the meshed portions indicate etched portions 30 and 31 that are etched as each electron beam passage aperture 24 is formed. If the joint portion 29 is located in the thickness-direction central portion of the mask body 23, as shown in FIG. 5A, then it is to be understood that the etched portions 30 and 31 are equally etched ranging from the joint portion 29 to the opposite surface sides of the mask body 23. If the joint portion 29 is situated close to either surface of the mask body 23, the one etched portion 30 has a larger area, as seen from FIG. 5B.

Figure 6:
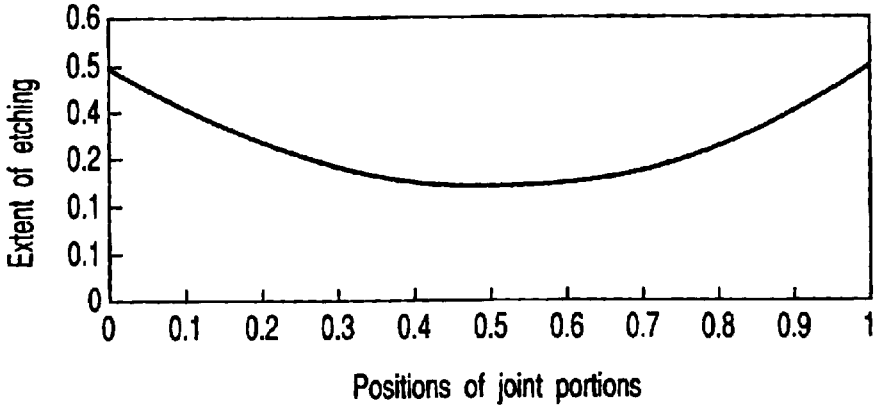
FIG. 6 shows a characteristic curve representing the relation between the extent of etching and the respective positions of joint portions of electron beam passage apertures of the shadow mask.

FIG. 6 shows the relation between the position of the joint portion 29 and the extent of etching of the mask body 23. In FIG. 6, the axis of abscissa represents the distance from the surface of the mask body 23 to the joint portion 29 in terms of a standardized value for the thickness of the mask body, while the axis of ordinate represents the extent of etching. If the position of the joint portion 29 is at 0.5, the joint portion is situated in the thickness-direction center of the mask body 23. If the position of the joint portion 29 is at 0 or 1, the joint portion is situated on the electron-gun- or phosphor-screen-side surface of the mask body.

When the joint portion 29 is situated in the position corresponding to 0.5, that is, in the thickness-direction center of the mask body 23, as seen from FIG. 6, the extent of etching of the mask body is minimized, and therefore, the volume of the mask body is maximized. As the joint portion 29 approaches either surface of the mask body, the extent of etching increases, so that the volume of the mask body is reduced.

The necessary extent of etching for the formation of the electron beam passage apertures 24 can be minimized in a manner such that the joint portion 29 between the larger and smaller holes 27 and 28 of each electron beam passage aperture is situated near the thickness-direction center of the mask body 23, in the central portion of the effective area A of the mask body. Thus, the volume of the etched mask body 23 can be maximized to improve the mask strength.

The strength of the peripheral portion of the mask body 23 can be also improved in a manner such that the joint portion 29 of each electron beam passage aperture 24 in the peripheral portion of the effective area A is situated in the thickness-direction central portion of the mask body 23. As mentioned before, however, the peripheral portion of the mask body 23 originally has high strength, since the skirt portion 26 and the mask frame 16 are welded to each other. In the peripheral portion of the mask body 23, therefore, each joint portion 29 need not always be situated in the thickness-direction central portion of the mask body.

If the strength of the peripheral portion of the mask body 23 is too high, on the other hand, it cannot be balanced with the strength of the central portion of the effective area A. In consequence, the strength of the central portion of the effective area A becomes relatively low, so that deformation of the shadow mask increases.

Figure 7:
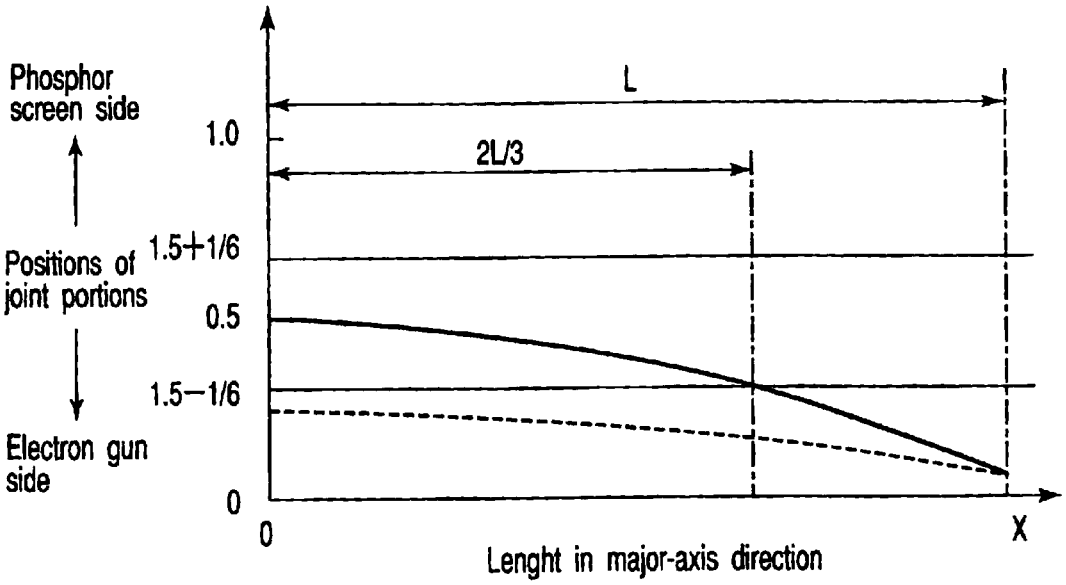
FIG. 7 shows curves representing the positional relation between the respective joint portions of the electron beam passage apertures of the shadow mask.

In order to prevent the strength of the mask body 23 from being unbalanced, it is to be desired that the joint portion 29 of each electron beam passage aperture 24 in the central portion of the effective area A should be situated in the thickness-direction central portion of the mask body 23, as shown in FIG. 7. The joint portion 29 of each electron beam passage aperture 24 near the short side of the mask body 23 or in the peripheral portion of the effective area A should be situated closer to the surface of the mask body 23 than the joint portion 29 of each electron beam passage aperture in the central portion of the effective area A. In consideration of the balance in strength and the angle of incidence of the electron beams 14, moreover, it is preferable that the joint portion 29 of each electron beam passage aperture 24 in the peripheral portion of the effective area A are situated closer to the electron-gun-side surface of the mask body 23 than the thickness-direction center.

The thickness-direction central portion covers a range of $0.5 \pm 1/6$, where 0.5 corresponds to the thickness-direction center of the mask body 23 compared with its thickness at 1. If the length from the minor axis Y of the mask body 23 to the short side of the effective area A is L, at least the electron beam passage apertures 24 situated in the region ranging from the minor axis Y to 2L/3 should preferably be formed in a manner such that their respective joint portions 29 are located in the thickness-direction central portion.

By establishing this balance, the difference in strength between the central and peripheral portions of the effective area A can be lessened to reduce deformation of the central portion that is the lowest in strength. In the peripheral portion of the mask body 23, the respective positions of the larger and smaller holes 27 and 28 of each electron beam passage aperture 24 are staggered. Therefore, in one electron beam passage aperture, a part of the joint portion 29 on the central side of the mask body possibly may be shifted in position with respect to another part of the joint portion 29 on the peripheral side of the mask body. In this case, the average position between the central side part and peripheral side part of the joint portion 29 may be considered.

According to the above-mentioned structure, as the electron beam passage apertures are formed, therefore, the extent of etching of the mask body 23 can be minimized to increase the substantial volume of the mask body. This increase of the volume of the mask body 23 can be regarded as equivalent to an increase in the thickness of the mask body. In consequence, the mask strength can be improved. Further, the balance in mechanical strength between the central and peripheral portions of the mask body 23 can be improved. Thus, there may be provided a color cathode ray tube in which deformation and vibration of the shadow mask can be restrained to ensure an improved image quality level.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, the present invention may be also applied to a shadow mask having electron beam passage apertures of which the aperture diameter of each smaller hole is smaller than the joint portion between larger and smaller holes, since the joint portion of each electron beam passage aperture projects toward the center of the hole in the thickness of the mask body. Based on this joint portion, the same effect of the foregoing embodiment can be obtained.

According to the embodiment described above, moreover, the position of each joint portion gradually approaches the surface side of the mask body from the region near the thickness-direction center of the mask body with distance from the central portion of the effective area A in the direction toward the major-axis-direction peripheral portion. Alternatively, however, the mask body may be divided into specific sections to be etched individually so that the position of each joint portion varies stepwise in the major-axis direction.

What is claimed is:

1. A shadow mask comprising:

a mask body including a substantially rectangular effective area having a minor axis and a major axis extending at right angles to each other; and a large number of electron beam passage apertures formed in the effective area, each of the electron beam passage apertures being formed of a communication hole connecting a larger hole opening in one surface of the effective area and a smaller hole opening in the other surface of the effective area, in a cross section of the mask body in the major axis direction, a joint portion between the larger and smaller holes of each of at least the electron beam passage apertures in the central portion of the effective area being situated within a range of 0.5±⅙ in the thickness direction of the mask body from one of surface sides of the effective area, as the thickness of the mask body being represented by 1, in a cross section of the mask body in the major axis direction, a joint portion between the larger and smaller holes of each of the electron beam passage apertures located on the major axis and in the peripheral portion of the effective area being situated closer to one of the surface sides of the effective area than the joint portion of each of the electron beam passages apertures in the central portion of the effective area, the larger hole being offset against the smaller hole in the direction of the major axis, the joint portion of each of the electron beam passage apertures in a region between the minor axis of the effective area and a position at a distance of 2L/3 in the major-axis direction from the minor axis being situated within the range of 0.5±⅙ in the thickness direction of the mask body from one of the surface sides of effective area, where L is the length from the minor axis of the effective area to a major-axis-direction end thereof, and the joint portion of each of the electron beam passage apertures in a region at the distance of 2L/3 or more in the major-axis direction from the minor axis of the effective area being situated outside the range of 0.5±⅙ in the thickness direction of the mask body.

2. A color cathode ray tube comprising:

an envelope including a substantially rectangular face panel having a phosphor screen on the inner surface thereof;

a shadow mask opposed to the phosphor screen; and an electron gun for emitting electron beams toward the phosphor screen through the shadow mask, the shadow mask comprising a mask body including:

a substantially rectangular effective area having a minor axis and a major axis extending at right angles to each other and a large number of electron beam passage apertures formed in the effective area, each of the electron beam passage apertures being formed of a communication hole connecting a larger hole opening in one surface of the effective area and a smaller hole opening in the other surface of the effective area, in a cross section of the mask body in the major axis direction, a joint portion between the larger and smaller holes of each of at least the electron beam passage apertures in the central portion of the effective area being situated within a range of 0.5±⅙ in the thickness direction of the mask body from one of surface sides of the effective area, as the thickness of the mask body being represented by 1, in a cross section of the mask body in the major axis direction, a joint portion between the larger and smaller holes of each of the electron beam passage apertures located on the major axis and in the peripheral portion of the effective area being situated closer to one of the surface sides of the effective area than the joint portion of each of the electron beam passages apertures in the central portion of the effective area, the larger hole being offset against the smaller hole in the direction of the major axis, the joint portion of each of the electron beam passage apertures in a region between the minor axis of the effective area and a position at a distance of 2L/3 in the major-axis direction from the minor axis being situated within the range of 0.5±⅙ in the thickness direction of the mask body from one of surface sides of the effective area, where L is the length from the minor axis of the effective area to a major-axis-direction end thereof, and the joint portion of each of the electron beam passage apertures in a region at the distance of 2L/3 or more in the major-axis direction from the minor axis of the effective area being situated outside the range of 0.5±⅙ in the thickness direction of the mask body.

* * * * *